US009506718B2

(12) United States Patent
Bell

(10) Patent No.: US 9,506,718 B2
(45) Date of Patent: Nov. 29, 2016

(54) PAINTBALL LOADER

(75) Inventor: David W. Bell, Mullica Hill, NJ (US)

(73) Assignee: Valken, Inc., Swedesboro, NJ (US)

( * ) Notice: Subject to any disclaimer, the term of this patent is extended or adjusted under 35 U.S.C. 154(b) by 1100 days.

(21) Appl. No.: 12/932,803

(22) Filed: Mar. 7, 2011

(65) Prior Publication Data

US 2012/0227722 A1 Sep. 13, 2012

(51) Int. Cl.
*F41B 11/57* (2013.01)
*F41B 11/53* (2013.01)

(52) U.S. Cl.
CPC ..... *F41B 11/57* (2013.01); *F41B 11/53* (2013.01)

(58) Field of Classification Search
USPC ..... 124/51.1, 53
See application file for complete search history.

(56) References Cited

U.S. PATENT DOCUMENTS 5,954,042 A * 9/1999 Harvey ..... 124/51.1
6,467,473 B1 * 10/2002 Kostiopoulos ..... 124/51.1
2003/0221684 A1 * 12/2003 Rice ..... 124/71
2009/0025701 A1 * 1/2009 Douglas et al. ..... 124/77
2009/0133680 A1 * 5/2009 Christopher et al. ..... 124/51.1
2011/0083654 A1 * 4/2011 Galinson ..... 124/59

* cited by examiner

*Primary Examiner* — Melba Bumgarner
*Assistant Examiner* — Amir Klayman
(74) *Attorney, Agent, or Firm* — Norman E. Lehrer

(57) ABSTRACT

The paintball loader of the present invention includes a housing having a hopper for holding a supply of paintballs. An outlet tube connected to the hopper is adapted to be connected to the inlet tube of a paintball gun. Located within the hopper is an electric motor-operated agitator capable of directing paintballs within the hopper toward the outlet tube so that the paintballs can pass through the outlet tube and into the inlet tube of the paintball gun. A sensing system located at least partially within the outlet tube senses the movement of paintballs through the outlet tube. The sensing system includes a rotatable wheel having a plurality of angularly spaced apart radially extending members. The wheel is rotatably mounted relative to the outlet tube such that paintballs passing through the tube engage the radially extending members and cause the wheel to rotate. A plurality of magnets carried by the wheel pass by a Hall effect sensor mounted on the housing as the wheel is rotated. This causes an electronic circuit associated with the Hall effect sensor to activate the electric motor to operate the agitator. In addition, a magnet fixed to the housing and capable of interacting with the plurality of magnets carried by the wheel stops the wheel from rotating unless it is engaged by a moving paintball.

3 Claims, 4 Drawing Sheets

PAINTBALL LOADER

BACKGROUND OF THE INVENTION

The present invention is directed toward paintball loaders, and more particularly, toward a paintball loader that uses a rotating star wheel and a Hall effect sensor for controlling the operation of a motor-driven active feed mechanism for directing paintballs to an infeed opening of a paintball gun.

A popular game has developed over the years which uses compressed gas guns commonly referred to as paintball guns. The game itself is generally referred to simply as paintball. In the game, each of two or more teams tries to capture the opposing team's flag. The players on each team carry paintball guns that shoot paintballs, gelatin-covered spherical capsules which contain a colored liquid. When a player is hit with a paintball fired from a gun, the paintball ruptures and leaves a colored mark on the hit player who must then leave the game. As the game of paintball has grown in sophistication, semi-automatic paintball guns that sequentially fire individual paintballs as fast as the trigger can be repeatedly pulled, have become more prevalent. The high firing rate capability of semi-automatic paintball guns has necessitated the use of bulk paintball loaders in conjunction with such guns.

Typically, existing paintball loaders or hoppers include a housing which is placed on a paintball gun. The loader is shaped to hold a large quantity of paintballs and has an outlet tube through which the paintballs are fed to be fired by the gun. The outlet tube leads to an inlet tube located on the upper portion of the gun. Several paintball loaders are described, for example, in U.S. Pat. Nos. 6,213,110, 6,502,567, and 6,792,933.

There are two main classes of paintball loaders, each having feed mechanisms for mixing or moving paintballs. The first class includes gravity feed or agitating loaders, such as shown in U.S. Pat. No. 5,947,100. Such loaders generally include a housing that holds a plurality of paintballs. An agitator, for mixing, stirring, or otherwise moving the paintballs is positioned within the housing to increase feed rates and prevent paintball jams. The agitators can take various forms, including paddle wheels, shaped members, arms, paddles, wires, fins, and vibrating members. Generally, the agitators are connected to a drive shaft and rotated or otherwise actuated by a motor.

The second main class of paintball loader includes active or force paintball loaders. These loaders force paintballs out of the outlet tube and into gun's inlet tube allowing for increased feeding rates. In an active feed paintball loader, the force feed mechanisms can take the form of drive cones, fins, paddles, arms, conveyors, carriers, or any other arrangements whereby paintball can be forced into or through the outlet tube of the loader.

One such active feed loader is shown, for example, in U.S. Pat. No. 5,816,232, incorporated herein by reference. In the active feed loader of the '232 patent, an impeller is situated in a surrounding well at the bottom of the loader housing and has curved arms that sequentially move paintballs one-by-one toward the outlet tube.

In both gravity feed and active or force feed loaders, sensors are frequently used to monitor a stack of paintballs as the paintballs are forced from the outlet tube into the inlet tube. Such sensors are used to send signals back to a motor for rotating the agitator or for initiating the force feed mechanism. In some systems, electronic circuitry and microprocessors are used to control or monitor the operation of the loaders based on signals received from the sensors.

Conventional sensors currently in use sense the absence, presence or movement of a paintball in the outlet tube using various techniques. These sensors take various forms from simple contact or limit switches that are mechanically activated when contacted by a paintball to optical and infrared sensors that can sense when a paintball interrupts or otherwise interferes with the electromechanical energy path between an emitter/detector pair.

While conventional sensors have met with some success, they have not been entirely satisfactory. Due to deficiencies in each type of sensor, they can malfunction or may be too slow in providing the necessary information.

There is, therefore, a need for a sensor that is reliable and which is capable of providing instantaneous information concerning the status of paintballs passing through a feed tube.

SUMMARY OF THE INVENTION

The present invention is designed to overcome the deficiencies of the prior art discussed above. It is an object of the present invention to provide a sensor for a paintball loader that is reliable.

It is another object of the present invention to provide a sensor for a paintball loader that accurately senses the passage of a paintball through the outlet tube of the paintball loader.

It is a further object of the present invention to provide a sensor for a paintball loader that accurately senses the passage of a paintball through the outlet tube of the paintball loader and which is reliable and maintenance free.

In accordance with the illustrative embodiments demonstrating features and advantages of the present invention, there is provided a paintball loader that includes a housing having a hopper for holding a supply of paintballs. An outlet tube connected to the hopper is adapted to be connected to the inlet tube of a paintball gun. Located within the hopper is an electric motor-operated agitator capable of directing paintballs within the hopper toward the outlet tube so that the paintballs can pass through the outlet tube and into the inlet tube of the paintball gun. A sensing system located at least partially within the outlet tube senses the movement of paintballs through the outlet tube. The sensing system includes a rotatable wheel having a plurality of angularly spaced apart radially extending members. The wheel is rotatably mounted relative to the outlet tube such that paintballs passing through the tube engage the radially extending members and cause the wheel to rotate. A plurality of magnets carried by the wheel pass by a Hall effect sensor mounted on the housing as the wheel is rotated. This causes an electronic circuit associated with the Hall effect sensor to activate the electric motor to operate the agitator. In addition, a magnet fixed to the housing and capable of interacting with the plurality of magnets carried by the wheel stops the wheel from rotating unless it is engaged by a moving paintball.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
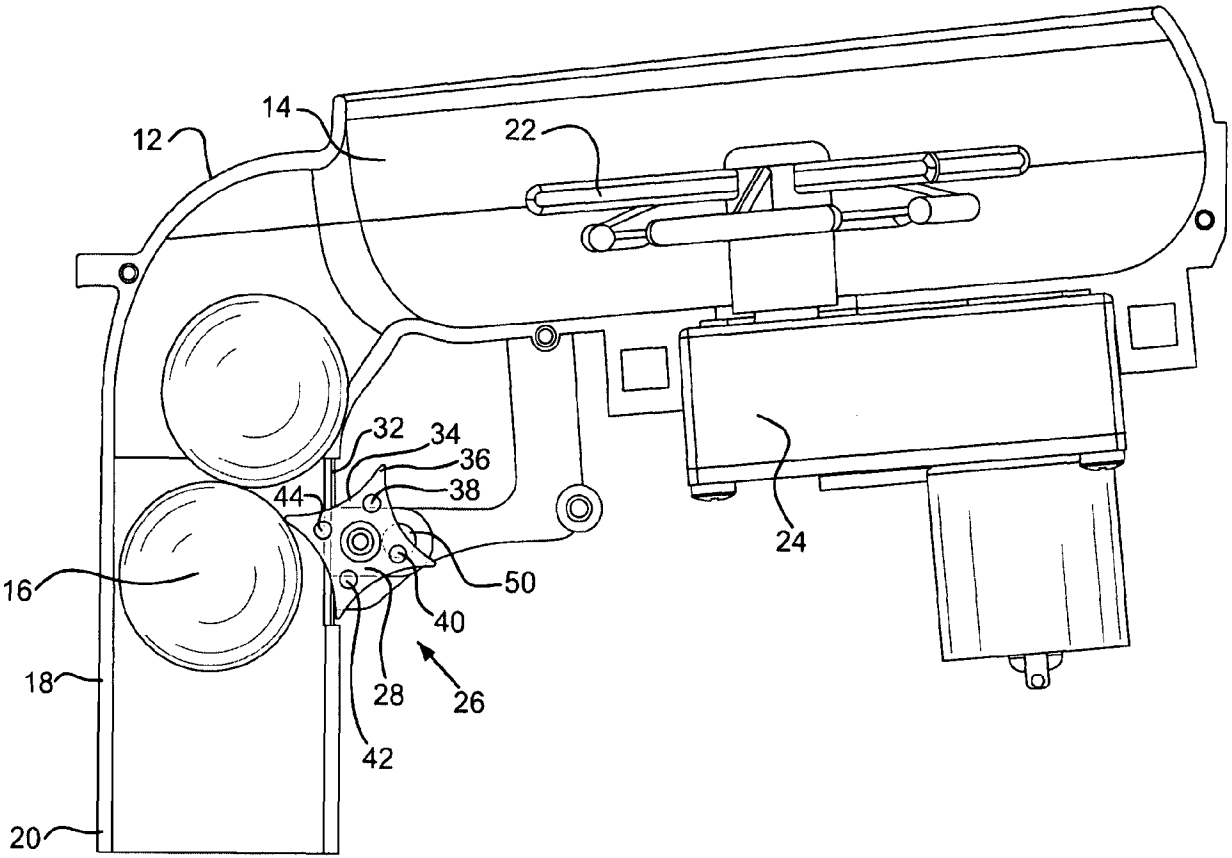
FIG. 1 is a sectional view from one side of the paintball loader of the present invention schematically showing the operating components thereof.
Figure 2:
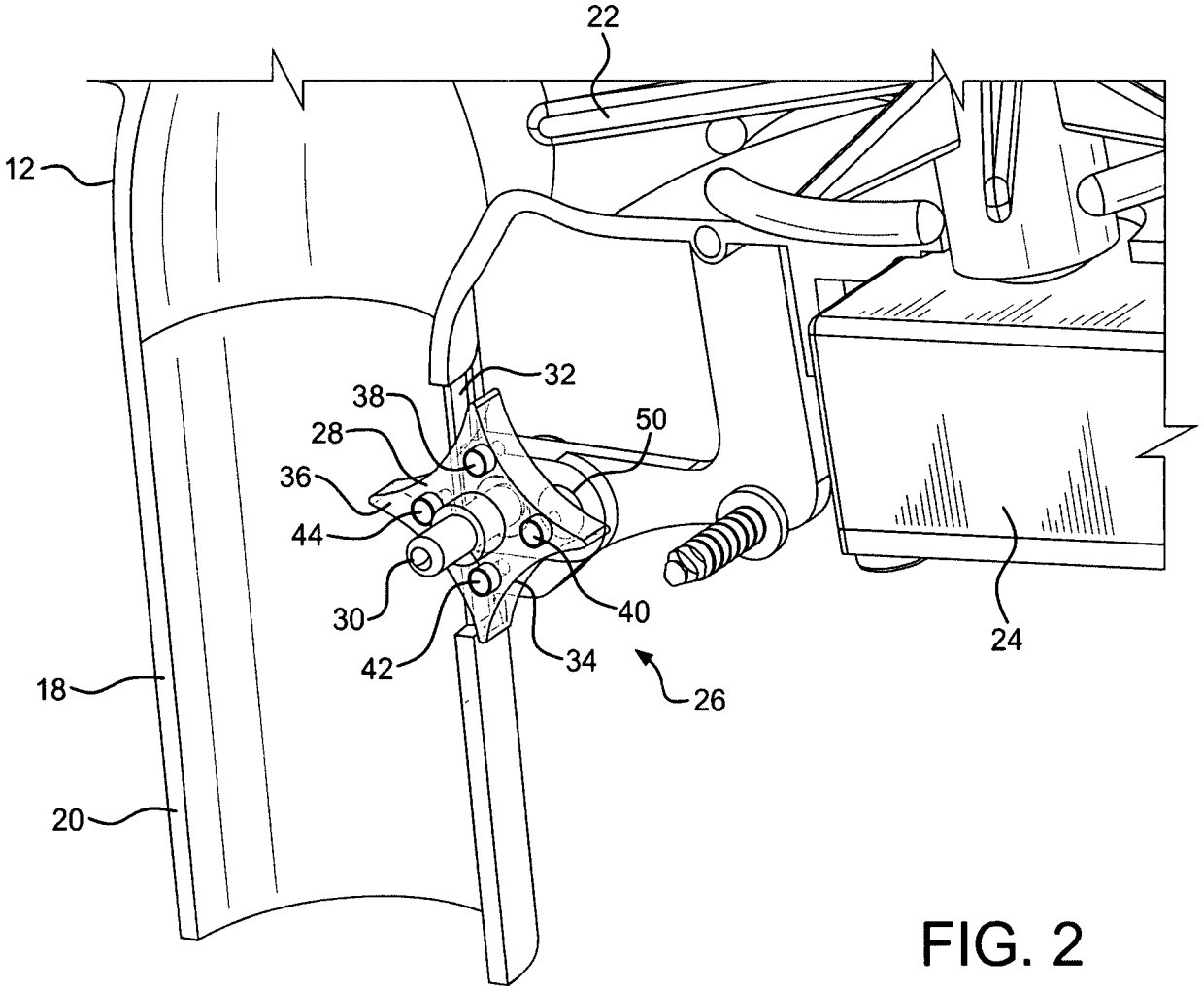
FIG. 2 is a view similar to FIG. 1 but showing a perspective view the rotatable wheel that forms a part of the invention.
Figure 3:
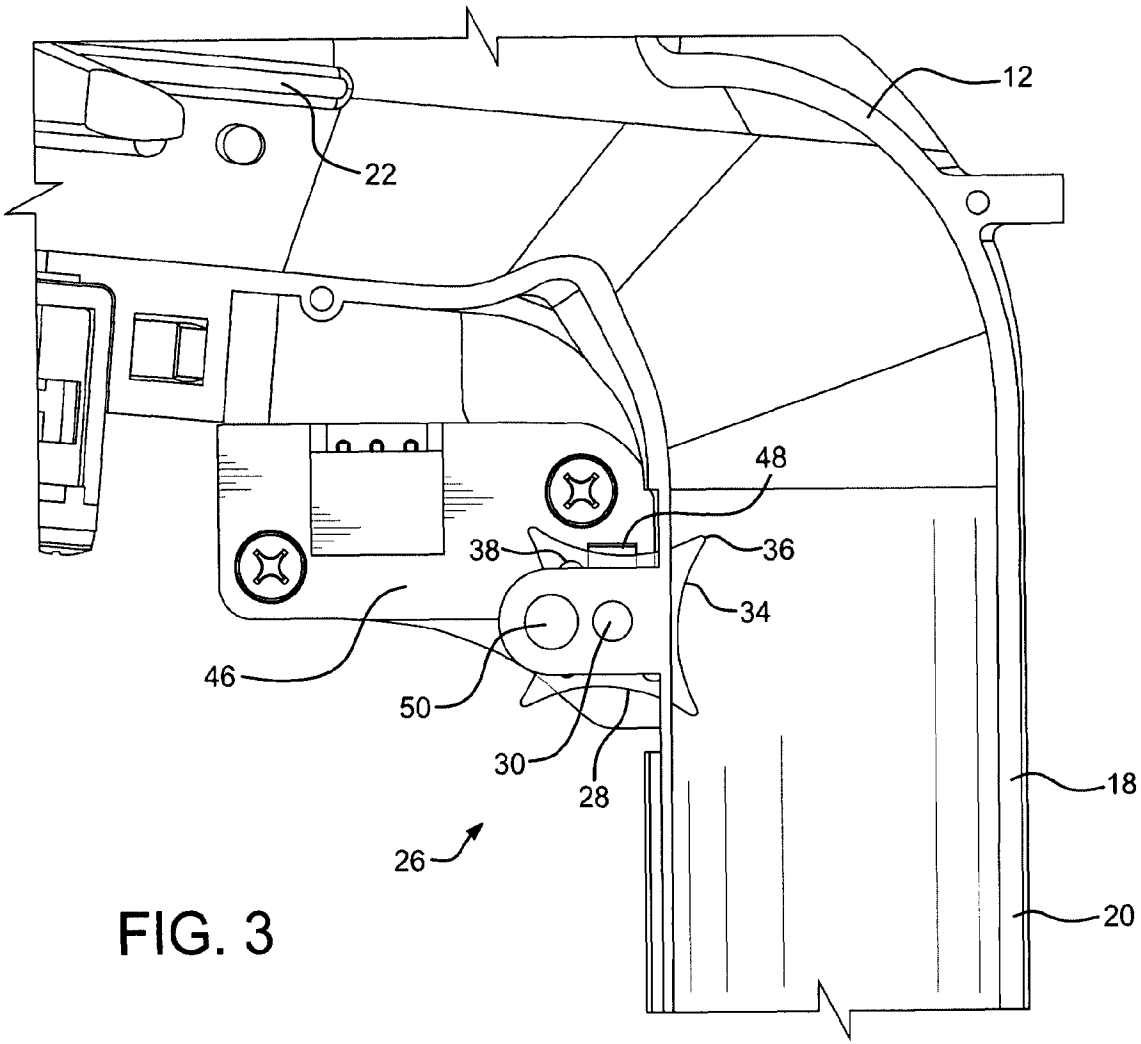
FIG. 3 is a sectional view from the opposite side of the paintball loader showing the interior thereof.

Referring now to the drawings in detail wherein like reference numerals have been used throughout the various figures to designate like elements, there is shown in FIGS. 1-3 a paintball loader constructed in accordance with the principles of the present invention and designated generally at 10. The paintball loader 10 is comprised essentially of a housing 12 including a hopper 14 for holding a supply of paintballs 16 therein. The housing 12 further includes an outlet tube 18 that is connected to the hopper 14 and which has a lower end 20. The lower end 20 of the outlet tube 18 is adapted to be connected to the inlet tube of a paintball gun (not shown).

Within the hopper 14 is an agitator 22 that is capable of directing paintballs within the hopper toward the outlet tube 18 so that the paintballs 16 may pass through the outlet tube and into the inlet tube of the paintball gun. The agitator 22 can also function to break up jambs that may form that might prevent the paintballs from flowing freely from the hopper to the outlet tube.

An electric motor 24, secured to the housing 12, is connected to the agitator 22 in order to drive the same. A sensing means, generally shown at 26, senses the movement of the paintballs 16 through the outlet tube 18. Through appropriate electrical circuits, the sensing means 26 along with other information that might be obtained is utilized to activate or deactivate the motor 24 to thereby drive or stop the agitator 22.

With the exception of the details of the sensor means 26 which will be described in more detail hereinafter, all of the above component parts and arrangement of parts are well known to those skilled in the field. Accordingly, these parts are shown essentially schematically since the details thereof are well known. Similarly, the manner in which the paintball loader 10 of the present invention is attached to a paintball gun is also conventional and well known. The present invention can, of course, be adapted for use with substantially any paintball gun.

The primary inventive features of the present invention lie in the specifics of the sensor means 26. As can be clearly seen in FIGS. 1 and 2, the sensor 26 is comprised of a rotatable wheel 28 that is mounted on axle 30 fixed to the housing 12 at a location adjacent the outlet tube 18. A vertically extending slot 32 is formed in the wall of the outlet tube 18 so that a portion of the wheel 28 enters the interior of the outlet tube 18.

The wheel 28 is essentially in the form of a disc having an outer periphery with a plurality of angularly spaced apart recesses 34 and a plurality of angularly spaced apart radially extending members 36. There are, therefore, alternating high points and low points on the periphery of the wheel 28.

In the preferred embodiment of the invention, there are four alternating high and low points. As shown, the high and low points 34 and 36 actually form a curved surface into which a portion of a paintball 16 can enter. As the paintballs pass downwardly through the outlet 18, they engage a high point on the wheel 28 and cause the same to turn 90° as the paintball passes through. Thus, the wheel 28 essentially acts as a turnstile.

While the wheel 28 is shown in the form of a modified square with four inwardly curved sides, this is, of course, by way of example only. Other shapes and forms are also possible. By way of example and not limitation, the wheel 28 could be simply in the form of a center axis with three or four or more spokes radially extending outwardly therefrom.

Four angularly spaced magnets such as shown at 38, 40, 42 and 44 are carried by the wheel 28 so as to rotate therewith. These magnets are equally spaced around the periphery of the wheel 28 and, preferably, in the vicinity of the high points 36. Secured to the housing 12 is a printed circuit board 46 having a Hall sensor 48 mounted thereon. (See FIG. 3) The Hall sensor 48 is located in such a position that it can sense the movement of one of the magnets 38-44 as it passes thereby. As is well known in the art, the Hall sensor then generates a signal which is received by the circuitry on the printed circuit board 46 for activating or deactivating the motor 24 attached to the agitator 22.

In order to prevent the wheel 28 from simply freely spinning when it is moved by a paintball 16 passing down through the outlet 18, an additional magnet 50 is mounted to the housing 12 in a fixed position. The interaction between the fixed magnet 50 and the rotating magnets 38-44 is strong enough to draw the closest rotating magnet to the fixed magnet 50 to stop the wheel 28 from rotating freely but it is not so strong as to prevent the wheel 28 from rotating when the next paintball passes through the outlet tube 18. The position of the fixed magnet 50 on the housing 12 is selected so that the wheel 28 is stopped in the proper position for the next paintball 16 to engage the same.

Figure 4:
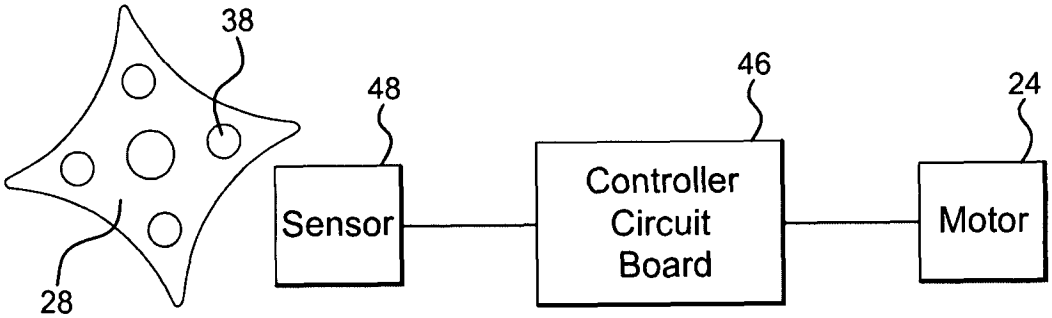
FIG. 4 is a schematic of the electrical circuit for controlling the paintball loader of the invention.

The electrical circuit of the invention is shown very generally and schematically in FIG. 4. As can be seen, when the Hall sensor 48 senses the movement of one of the magnets such as magnet 38 pass the same, a signal is sent to the controller in the circuit board 46. This information along with other information is used to stop or start the motor 24. By way of example, each time the sensor 48 senses the movement of one of the paintballs 16, the controller 46 can start the motor 24 to activate the agitator 22. Other inputs to the controller in the circuit board 46 could also be used to control the motor 24. For example, a signal from the trigger of the paintball gun along with a signal from the sensor 48 could be used to activate the motor 24. Similarly, various timers could be included in the controller 46 to activate the motor 24 if a certain amount of time has passed after sensing a trigger pull but without sensing the movement of one of the paintballs 16 through the outlet tube 18. Numerous other variations in the controller 46 and operation thereof will also be readily apparent to those skilled in the art.

The present invention may be embodied in other specific forms without departing from the spirit or essential attributes thereof and accordingly, reference should be made to the appended claims rather than to the foregoing specification as indicating the scope of the invention.

I claim:

1. A paintball loader comprising:

a housing including a hopper for holding a supply of paintballs therein;

said housing further including a downwardly extending outlet tube connected to said hopper and being adapted to be connected to the inlet tube of a paintball gun;

an agitator within said hopper capable of directing paintballs within said hopper toward said outlet tube so that said paintballs may pass through said outlet tube downwardly and into said inlet tube of said paintball gun;

electric motor means carried by said housing and connected to said agitator for moving said agitator;

sensing means located at least partially within said outlet tube for sensing the movement of paintballs through said outlet tube;

said sensing means including a rotatable wheel having a plurality of angularly spaced apart radially extending members, said rotatable wheel being rotatably mounted about a horizontal axis and being positioned relative to said outlet tube such that paintballs passing downwardly through said outlet tube engage said radially extending members and cause said wheel to rotate, said wheel being rotated by the weight of said paintballs engaging the same;

said sensing means further including a plurality of magnets carried by said wheel and a Hall effect magnetic sensor carried by said housing and located so as to sense the movement of one of said magnets when said wheel is rotated by one of said paintballs passing downwardly through said outlet tube, and electronic circuit means associated with said magnetic sensor for activating said electric motor means in response to signals from said magnetic sensor.

2. The paintball loader as claimed in claim 1 wherein said wheel is in the form of a disc having an outer periphery with a plurality of angularly spaced apart recesses forming alternating high points and low points, said paintballs being adapted to fit between adjacent high points.

3. The paintball loader as claimed in claim 1 further including a magnet fixed to said housing capable of interacting with said plurality of magnets carried by said wheel for stopping said wheel from rotating unless engaged by a paintball moving downwardly through said outlet tube.

* * * * *